United States Patent [19]

Liautaud

[11] 4,365,449

[45] Dec. 28, 1982

[54] HONEYCOMB FRAMEWORK SYSTEM FOR DROP CEILINGS

[75] Inventor: James P. Liautaud, 70 Bluff Rd., Cary, Ill. 60013

[73] Assignee: James P. Liautaud, Cary, Ill.

[21] Appl. No.: 221,771

[22] Filed: Dec. 31, 1980

[51] Int. Cl.[3] ..... E04B 5/60

[52] U.S. Cl. ..... 52/28; 52/39; 52/488; 52/777; 362/217

[58] Field of Search ..... 52/484, 28, 39, 508, 52/477, 511, 506, 288, 507, 779, 781, 306, 307, 308, 144–145, 488, 777; 362/127, 146, 217, 356, 359, 362; 98/40 D, 40 DL

[56] References Cited

U.S. PATENT DOCUMENTS

| | | | |
|---|---|---|---|
| 716,061 | 12/1902 | Landkrohn | 52/508 |
| 731,158 | 6/1903 | Blackmore | 52/306 |
| 3,298,299 | 1/1967 | Little et al. | 98/40 DL |
| 3,333,383 | 8/1967 | Randebaugh, Jr. | 52/508 |
| 3,358,577 | 12/1967 | Thomson | 98/40 D |
| 3,656,577 | 4/1972 | Larson et al. | 52/145 |
| 3,678,635 | 7/1972 | Vagi et al. | 52/28 |
| 3,685,238 | 8/1972 | Fisher et al. | 52/781 |
| 3,755,667 | 8/1973 | Price | 52/28 |
| 3,968,837 | 7/1976 | Makara | 52/145 |
| 3,996,458 | 12/1976 | Jones et al. | 52/306 |

*Primary Examiner*—John E. Murtagh
*Assistant Examiner*—Richard E. Chilcot, Jr.
*Attorney, Agent, or Firm*—Hill, Van Santen, Steadman, Chiara & Simpson

[57] ABSTRACT

A method and apparatus for producing a honeycomb pattern of projecting frameworks from a drop ceiling utilizes cardboard rectangular frameworks having four side walls with respective hinged locking flaps along a top edge of the side walls. As the cardboard frameworks are inserted from below into rectangular support frames of the drop ceiling, the hinged locking flaps are pushed flush against outside surfaces of the framework side walls until they clear the support frames. After clearance is achieved, the locking flaps assume a locking position wherein they abut against a corner formed by T-section channels of the drop ceiling defining the support frames.

14 Claims, 4 Drawing Figures

HONEYCOMB FRAMEWORK SYSTEM FOR DROP CEILINGS

BACKGROUND OF THE INVENTION

1. Field of the Invention

This invention relates to an ornamental framework system and more particularly to a framework system for use with drop ceilings.

2. Description of the Prior Art

It is known to provide a honeycomb effect in a drop ceiling by removing selected ceiling tiles and replacing them from above with metal rectangular shields or rectangular frameworks having a horizontal lip formed along an upper periphery thereof which engages with a horizontal portion of T-shaped channels typically employed in forming a supporting system for the drop ceiling.

Such prior art framework systems are extremely costly to construct and even more costly to install since the framework must be installed from above the drop ceiling. In many cases, insufficient clearance may be provided between a drop ceiling and the actual ceiling so as to preclude the use of the above-described prior art systems.

SUMMARY OF THE INVENTION

It is an object of this invention to reduce the cost of providing a honeycomb effect drop ceiling framework system.

It is a further object of this invention to simplify installation expenses for the above-described style of honeycomb framework system.

According to the invention, the framework is constructed entirely of cardboard, preferably a strip of cardboard bent in a rectangle. At the tops of at least two of the side walls lying opposite one another a locking flap is hingeably connected to the top of the side wall and is bent in an outwardly and downwardly direction. The side walls are preferably painted flat black. To install the framework of the invention, after an existing ceiling tile is removed from below the drop ceiling, the cardboard framework of the invention is pushed from below the drop ceiling up into the drop ceiling support frame such that the locking flaps are flush against the outside surface of the associated side walls. After the ends of the locking flaps clear the supporting frame, they spring outwardly into a locking position wherein ends of the locking flaps abut in a corner of the inverted T-section shaped channels forming the drop ceiling supporting system.

Surprisingly, it has been found that cardboard has sufficient strength and durability to replace the prior art metal systems. The side walls between opposite locking flaps has sufficient strength to resist the inward forces resulting from the engagement of the locking flaps, particularly since the entire unit is much lighter than the prior art metal framework systems.

Manufacture time is substantially reduced by employing a single strip of cardboard bent into a rectangle and then sealed at an overlap.

DESCRIPTION OF THE PREFERRED EMBODIMENTS

Figure 1:
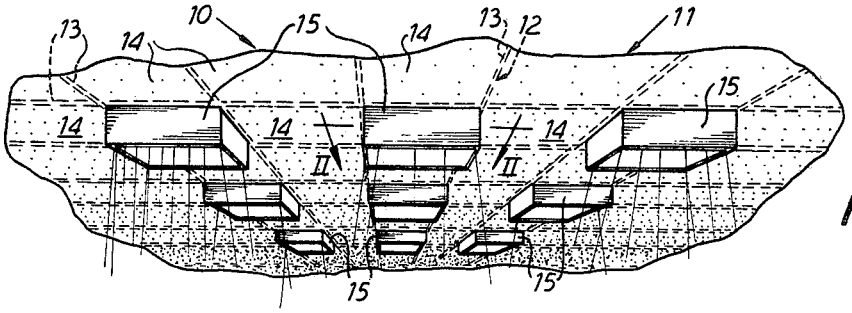
FIG. 1 is a perspective view of the honeycomb framework system according to the invention installed in a drop ceiling.

The drop ceiling honeycomb framework system of the invention is generally illustrated at 10 in FIG. 1. A drop panel ceiling 11 has a supporting grid 12 formed of a plurality of inverted T-section channels 13 oriented parallel and at right angles to one another so as to form individual rectangular support frames for receiving ceiling panels 14. Interspersed among the ceiling panels 14 are cardboard ornamental frameworks or light shields 15 according to the invention.

Figure 2:
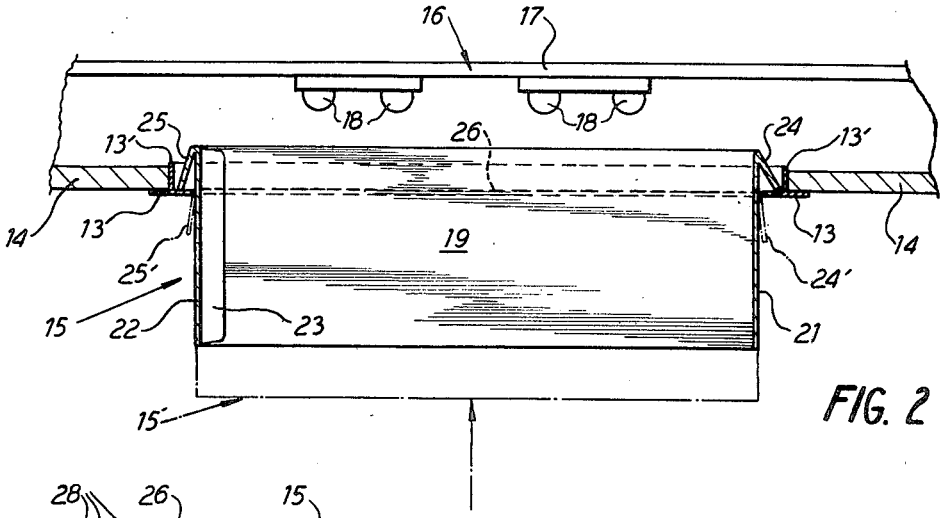
FIG. 2 is an enlarged fragmentary side view taken along line II—II of FIG. 1 showing one of the inventive frameworks installed in accordance with the inventive techniques of the invention.

As shown in FIG. 2, a lighting system 16 is typically provided above the drop ceiling such as by an electrically conductive track 17 with movable spot or floodlights 18 positioned above each of the frameworks such that light rays will shine downwardly through the framework or shield to provide a unique aesthetic impression to one observing the ornamental drop ceiling pattern.

The framework illustrated in FIG. 2 is formed of side walls 19, 20, 21 and 22. The side walls are preferably formed by a strip of cardboard bent in a rectangle and sealed at an overlap 23. Although cardboard is preferred, other light inexpensive materials which are flexible and easily handled may be employed. The cardboard is also preferably heat treated to withstand the heat generated by the light source.

Each of the side walls is most effectively provided with a flat black paint coating which, when contrasted with a typical white drop ceiling, provides a spectacular visual honeycomb effect.

Each of the side walls 19-23 has a respective hinged locking flap 24-27 formed of the same material as the side walls. This locking flap can be formed along a bend line having slots or perforations 28 which enhance bending of the flaps.

Figure 3:
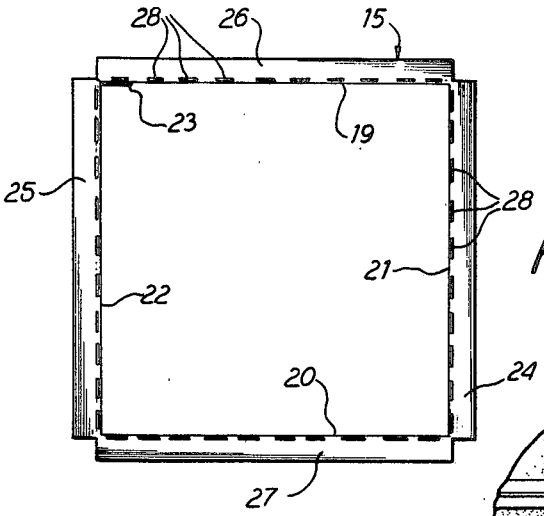
FIG. 3 is a top view of a framework of the invention prior to installation in a drop ceiling.
Figure 4:
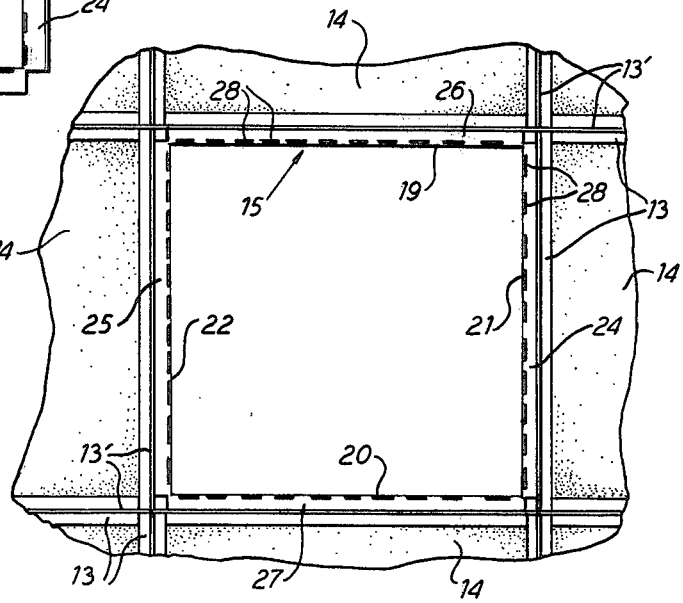
FIG. 4 is a top view of the framework shown in FIG. 2.

At least two locking flaps are required to retain the framework in position as long as the locking flaps are on opposite side walls of the framework. Four locking flaps may also be employed as shown in FIG. 3.

When installing the framework as shown in FIG. 2, the installer simply pushes the framework in an upwardly direction through the opening in the drop ceiling grid such that the T-shaped channel sections force the locking flaps into a downward flush position against the outer surface of the side walls. As soon as the locking flaps clear the T-sections, they spring open into a locking position such that ends of the locking flaps abut into a corner formed by the vertical 13' and horizontal portions of the T-section. The flush position of the locking flaps is shown at 24' and 25' as the framework 15' is being inserted.

With the invention, a honeycomb framework system has been developed which is extremely inexpensive to produce yet is surprisingly rigid while providing the neat aesthetic appearance required. Installation costs are dramatically reduced since insertion can be accomplished from below the drop ceiling.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A drop ceiling framework system for use in a drop ceiling formed of a grid of inverted T-shaped channels with rectangular removable ceiling tiles resting on rectangular support frames formed by the grid of T-shaped channels, and wherein a light source means is provided above the drop ceiling, comprising:

a rectangular cardboard framework having an open top and bottom and being formed of four interconnected side walls;

the rectangular framework being dimensioned to closely fit in a plurality of the rectangular support frames of the drop ceiling in place of the ceiling tiles so that light is substantially blocked from passing between each side wall and an adjacent portion of the rectangular support frame; and at least two of the side walls opposite one another having a locking flap at a top thereof formed of a hinged portion adapted to fold flush against an outside surface of the associated side wall during upward insertion of the cardboard framework into and through one of the ceiling rectangular support frames and then spring outwardly into a locking position after clearing a horizontal portion of the T-shaped channel and abut in a corner portion of the T-shaped channel formed between vertical and horizontal portions thereof.

2. The framework system of claim 1 wherein the side walls are flat black.

3. The framework system of claim 1 wherein the locking flap is hinged to the associated side wall along a bend line having spaced perforations adapted to promote bending along the bend line.

4. The framework system of claim 1 wherein each framework is square.

5. The framework system of claim 1 wherein each side wall has an associated locking flap.

6. The framework system of claim 1 wherein each framework has no outwardly extending rigid horizontal portions.

7. The framework system of claim 1 wherein each framework is formed of a cardboard strip bent into a rectangle and secured at an overlap between ends of the strip.

8. A ceiling framework system, comprising:

a drop ceiling formed of a grid of inverted T-shaped channels interconnected to form rectangular support frames;

a rectangular cardboard framework having four side walls, an open top and bottom, and dimensioned to correspond with dimensions of the rectangular support frames;

at least two locking flaps hingedly connected at the respective tops of two of the side walls which are opposite one another; and the framework being supported in position within the rectangular support frame by locking flaps such that a free end of each of the locking flaps abuts a corner formed by the horizontal and vertical portions of the inverted T-section, and with the locking flap forming an angle with the horizontal and vertical portions.

9. A system according to claim 8 wherein a light source is positioned above drop ceiling so as to shine through the cardboard framework, the framework serving as a light shield.

10. A system according to claim 8 wherein the inner and outer surfaces of the four side walls are flat black.

11. A system according to claim 8 wherein some of the drop ceiling support frames have ceiling tiles therein and other support frames have the cardboard frameworks supported therein.

12. A method for providing a honeycomb pattern of projecting frameworks from a drop ceiling formed of inverted T-section channels in a grid pattern defining rectangular support frames with ceiling tiles in at least some of the support frames, comprising the steps of:

providing the frameworks as a cardboard rectangle having four side walls, at least two of which lying opposite one another have respective hinged locking flaps along a top edge thereof which are folded outwardly and downwardly; and inserting the framework in an upwardly direction into a support frame which does not have a ceiling tile such that the locking flaps are pushed flush against the outside surface of the respective walls until they clear the support frame at which time they spring outwardly into a locking position wherein outer edges of the flaps abut in a corner formed by horizontal and vertical surfaces of the inverted T-sections.

13. The method of claim 12 wherein existing ceiling tiles are removed in a predetermined honeycomb pattern and replaced by the frameworks.

14. The method of claim 12 wherein the frameworks are positioned below light sources.

* * * * *